US010892134B2

(12) United States Patent
Yamakata et al.

(10) Patent No.: US 10,892,134 B2
(45) Date of Patent: Jan. 12, 2021

(54) X-RAY GENERATOR

(71) Applicant: RIGAKU CORPORATION, Akishima (JP)

(72) Inventors: Masaaki Yamakata, Akishima (JP); Tomohiro Chaki, Akishima (JP); Masaru Kuribayashi, Akishima (JP)

(73) Assignee: RIGAKU CORPORATION, Akishima (JP)

( * ) Notice: Subject to any disclaimer, the term of this patent is extended or adjusted under 35 U.S.C. 154(b) by 195 days.

(21) Appl. No.: 16/116,196

(22) Filed: Aug. 29, 2018

(65) Prior Publication Data

US 2019/0074155 A1 Mar. 7, 2019

(30) Foreign Application Priority Data

Sep. 5, 2017 (JP) ..... 2017-170242

(51) Int. Cl.
*H01J 35/10* (2006.01)

(52) U.S. Cl.
CPC ..... *H01J 35/106* (2013.01); *H01J 2235/1262* (2013.01)

(58) Field of Classification Search
CPC .. H01J 2235/1262; H01J 35/106; H01J 35/16; H01J 2235/12; H01J 2235/20; H01J 35/101
See application file for complete search history.

(56) References Cited

U.S. PATENT DOCUMENTS 4,625,324 A * 11/1986 Blaskis ..... H01J 35/16 313/22
4,945,562 A * 7/1990 Staub ..... H01J 35/106 378/130
7,186,021 B1 * 3/2007 Breham ..... H01J 35/16 378/199
10,705,030 B2 * 7/2020 Watanabe ..... H01J 35/04
2006/0013364 A1 * 1/2006 Sakata ..... H01J 35/106 378/130

FOREIGN PATENT DOCUMENTS

JP H08-507647 A 8/1996
JP 2006-179240 A 7/2006
WO 95/19039 A1 7/1995

OTHER PUBLICATIONS

Japanese Patent Office's Notice of Reasons for Refusal for Patent Application 2017-170242 dated Aug. 28, 2020 with an English language translation. (9 pages).

* cited by examiner

*Primary Examiner* — David P Porta
*Assistant Examiner* — Fani Boosalis
(74) *Attorney, Agent, or Firm* — Buchanan Ingersoll & Rooney PC

(57) ABSTRACT

An X-ray generator comprising a target for receiving electrons and generating X-rays, a separator for dividing an internal space of the target into a coolant inflow path and a coolant outflow path, a motor for rotating the target, and a coolant inflow path and a coolant outflow path for supplying a coolant to the coolant inflow path and recovering the coolant through the coolant outflow path, wherein the separator rotates in the same rotation direction as the target when the target rotates. In the X-ray generator in which a coolant inflow path and a coolant outflow path are provided by a separator inside a rotating target, reduced torque load and reduced vibration can be realized.

9 Claims, 12 Drawing Sheets

X-RAY GENERATOR

BACKGROUND OF THE INVENTION

Field of the Invention

The present invention relates to an X-ray generator in which a coolant such as water is circulated inside a rotating anode so as to cool the rotating anode. The present invention particularly relates to an X-ray generator in which a separator is provided inside the rotating anode, and a coolant inflow path and a coolant outflow path are thereby provided inside the rotating anode.

Description of the Related Art

A conventional X-ray generator is disclosed in JP-A 2006-179240 (Patent Citation 1). In this conventional X-ray generator, a partition pipe as an inner cylinder and a rotary shaft as an outer cylinder are provided coaxially. The partition pipe and the rotary shaft are both hollow cylinders. A separator is attached to the distal end of the partition pipe. A target is attached to the distal end of the rotary shaft. The separator is housed in the target.

When electrons impinge on the target, X-rays are emitted from the portion of the target impinged upon by the electrons. The target is heated to a high temperature by electron impingement. In order to prevent the target from reaching a high temperature equal to or higher than an allowable limit, a coolant, e.g., water, is supplied to a coolant inflow path formed inside a rotating anode by the separator. The supplied water cools the target from the back side of the target. The water after cooling is recovered through a coolant outflow path.

In the conventional X-ray generator described above, the target rotates at high speed. The target rotates at a high speed of 9000 rpm, for example. Meanwhile, the separator disposed inside the target is immovably fixed in position so as not to rotate. A narrow interval of 1.5 mm, for example, is also set between the separator and the portion of the target impinged upon by electrons. When the coolant flows through this narrow interval, there is an extremely large difference in speed between the coolant in contact with an inner surface of the target and the coolant in contact with an outer surface of the separator. The water is thereby stirred effectively, and as a result, the target can be efficiently cooled from the inside.

However, in the X-ray generator disclosed in Patent Citation 1, because of the large difference in speed between the coolant on the inner surface of the target and the coolant on the outer surface of the separator, the problem arises that a drive source, e.g., an electric motor, for rotating the target must have a large torque. The problem of increased vibration also arises due to intense stirring of the coolant between the inner surface of the target and the outer surface of the separator.

PATENT CITATIONS (Patent Citation 1): JP-A 2006-179240

SUMMARY OF THE INVENTION

The present invention as developed in view of the foregoing problems of the conventional apparatus, and an object of the present invention is to reduce torque load and reduce vibration in an X-ray generator in which a coolant inflow path and a coolant outflow path are provided by a separator inside a rotating target.

(Solution 1)

The X-ray generator according to the present invention is an X-ray generator comprising a target for receiving electrons and generating X-rays, a separator for dividing an internal space of the target into a coolant inflow path and a coolant outflow path, a target driving device for rotating said target, and a cooling system for supplying a coolant to the coolant inflow path and recovering the coolant through the coolant outflow path, wherein and the separator rotates in the same rotation direction as the target when the target rotates.

(Solution 2)

In a second aspect of the X-ray generator according to the present invention, the separator rotates at the same rotation speed as the target.

(Solution 3)

In a third aspect of the X-ray generator according to the present invention, the separator comprises a protruding spacer, and the spacer is pressed on an inner surface of the target, whereby the separator rotates when the target rotates.

(Solution 4)

In a fourth aspect of the X-ray generator according to the present invention, the spacer is a fin for guiding a flow of the coolant.

(Solution 5)

A fifth aspect of the X-ray generator according to the present invention comprises a hollow inner tube for supporting the separator so that the separator can rotate about a center of the separator, and a hollow outer tube provided coaxially with the inner tube, the target being supported by the outer tube, a hollow part of the inner tube being communicated with the coolant inflow path, a hollow part between an inner surface of the outer tube and an outer surface of the inner tube being communicated with the coolant outflow path, and a gap for allowing the separator to rotate being provided to a portion of the inner tube that supports the separator.

(Solution 6)

A sixth aspect of the X-ray generator according to the present invention comprises a coolant flow velocity accelerating device for increasing the velocity of the coolant in the inner tube at the location thereof where the gap is provided.

(Solution 7)

In a seventh aspect of the X-ray generator according to the present invention, the coolant flow velocity accelerating device is a tapered tube in which the diameter of the inner tube gradually decreases.

(Solution 8)

In an eighth aspect of the X-ray generator according to the present invention, a first opening as an end opening on a small-area side of the tapered tube is open in one wall surface of the gap, a second opening as an opening for receiving the coolant exiting the opening of the tapered tube is open in another wall surface of the gap, and $1.2D1 \leq D2 \leq 1.27D1$, where D2 is the diameter of the second opening and D1 is the diameter of the first opening.

Effect of the Invention

Through the present invention, the target and the separator rotate together in the same direction, and there is therefore no difference in speed of the water between the inner surface of the target and the outer surface of the separator in a cooling region. The driving device for rotating the target can therefore have a small torque. There is also no intense stirring of the water between the inner surface of the target and the outer surface of the separator, and there is therefore little vibration of the X-ray generator.

DESCRIPTION OF THE PREFERRED EMBODIMENTS

Figure 1:
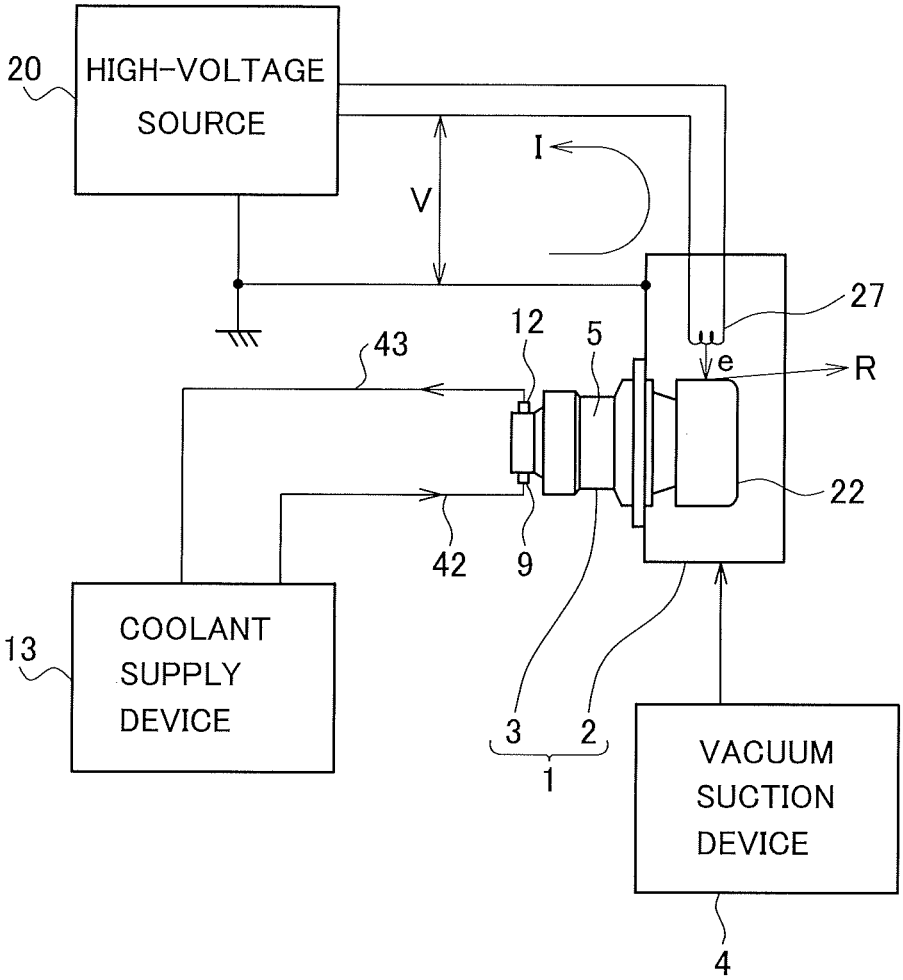
FIG. 1 is a diagram illustrating the overall structure of an embodiment of the X-ray generator according to the present invention.

The X-ray generator according to the present invention is described below on the basis of embodiments thereof. The present invention is, of course, not limited by these embodiments. In the drawings accompanying the present specification, constituent elements are sometimes illustrated as having different proportions to those of the actual elements in order to facilitate understanding of characterizing portions.

First Embodiment of X-Ray Generator

Figure 2:
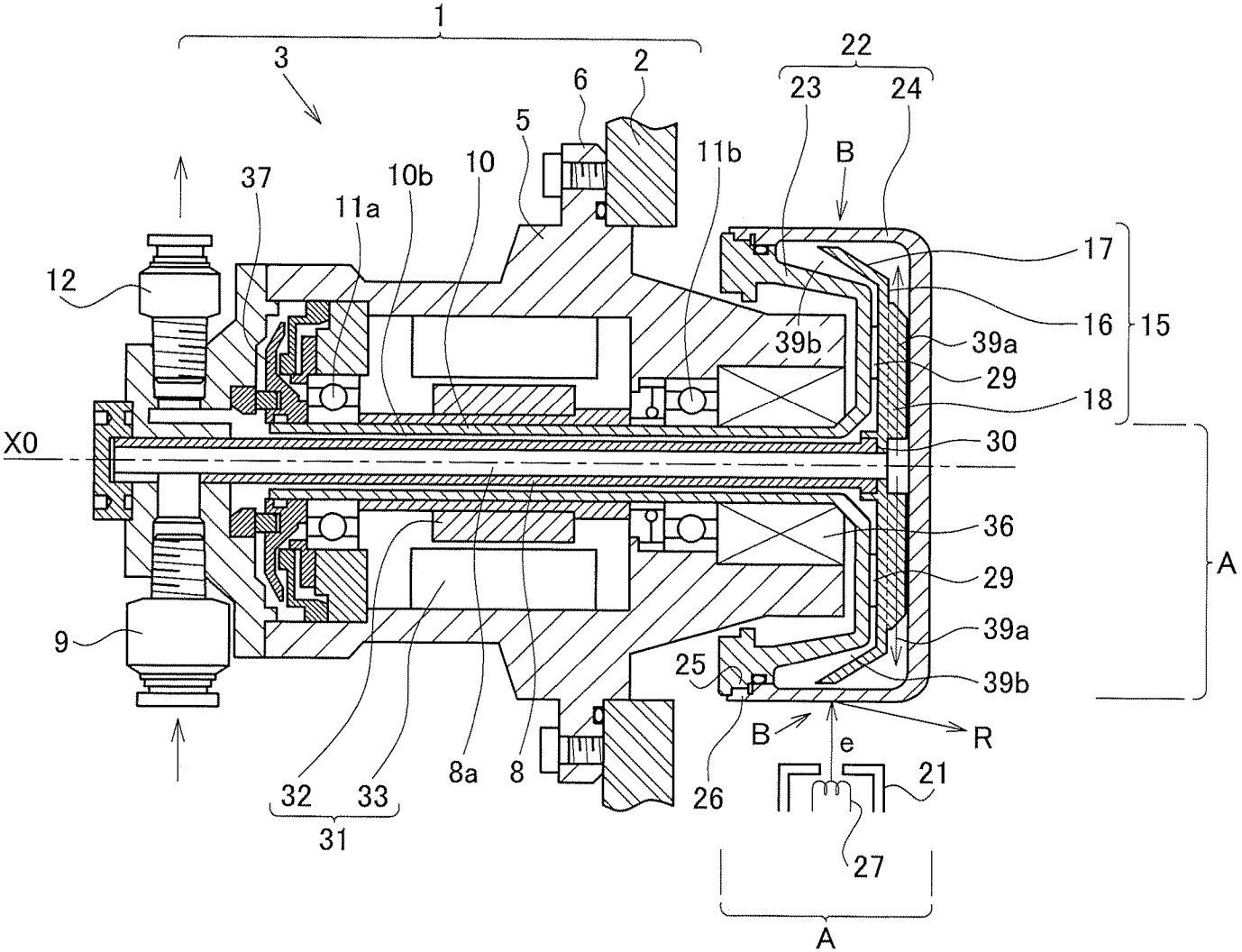
FIG. 2 is a sectional view of the X-ray generator of FIG. 1.

FIG. 1 is a diagram illustrating the overall structure of an embodiment of the X-ray generator according to the present invention. An X-ray generator 1 in FIG. 1 has a vacuum container 2 and an anode assembly 3. A vacuum state is maintained inside the vacuum container 2 by a vacuum suction device 4. In FIG. 2, the anode assembly 3 has a generally cylindrical casing 5. A flange 6 provided to the casing 5 is fixed to the vacuum container 2.

An inner tube 8 is provided in a center part of the inside of the casing 5. The inner tube 8 is a hollow cylindrical tube. The inner tube 8 is fixed to a left end part of the casing 5, and extends along the center axis X0 of the casing 5. The inner tube 8 is fixed in a state of neither rotating nor changing position. A hollow part of the inner tube 8 functions as a coolant inflow path 8*a*. A left end part of the coolant inflow path 8*a* is connected to an inlet fitting 9. The inlet fitting 9 is connected to a coolant supply tube 42 extending from a coolant supply device 13 in FIG. 1.

In FIG. 2, an outer tube 10 is provided on the outside of the inner tube 8. The outer tube 10 is a hollow cylindrical tube. The outer tube 10 is supported by two bearings 11*a*, 11*b* so as to be able to rotate about the center axis X0. The inner tube 8 and the outer tube 10 extend in the left-right direction of FIG. 2 along the same center axis X0. A space between the inner tube 8 and the outer tube 10 functions as a coolant outflow path 10*b*. A left end part of the coolant outflow path 10*b* is connected to an outlet fitting 12. The outlet fitting 12 is connected to a coolant recovery tube 43 extending from the coolant supply device 13 in FIG. 1.

Figure 3:
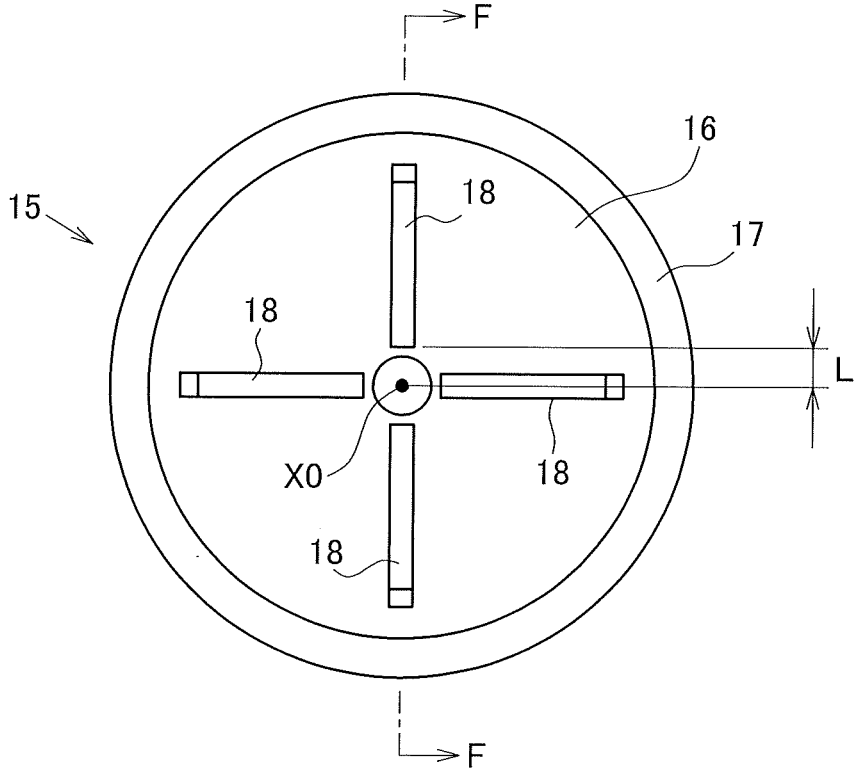
FIG. 3 is a front view of the separator as a main component used in the X-ray generator of FIG. 2.
Figure 4:
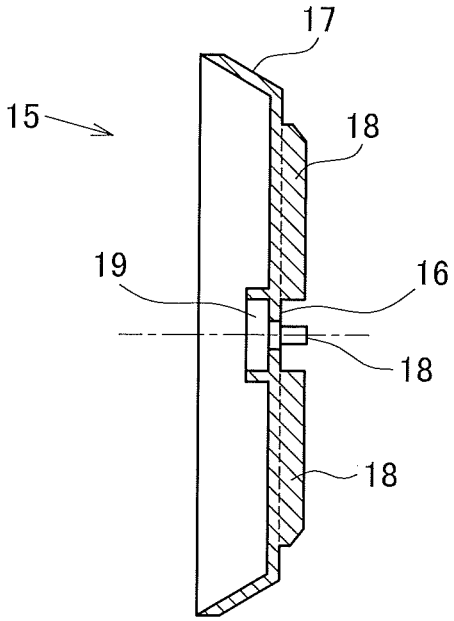
FIG. 4 is a sectional view along line F-F in FIG. 3.

A separator 15 is attached to the distal end of the inner tube 8 on the right side thereof in FIG. 2. As illustrated in FIGS. 3 and 4, the separator 15 has a circular plate part 16, an inclined part 17, and a plurality of fins (i.e., blade members) 18 for functioning as inflow-side spacers. The inclined part 17 is provided in a circumferential edge part of the circular plate part 16. Four fins 18 are provided in the present embodiment. The four fins 18 extend radially from the center of the circular plate part 16 at equal angle intervals of 90°. A recess 19 is provided in a back surface of a center part of the circular plate part 16.

Figure 5:
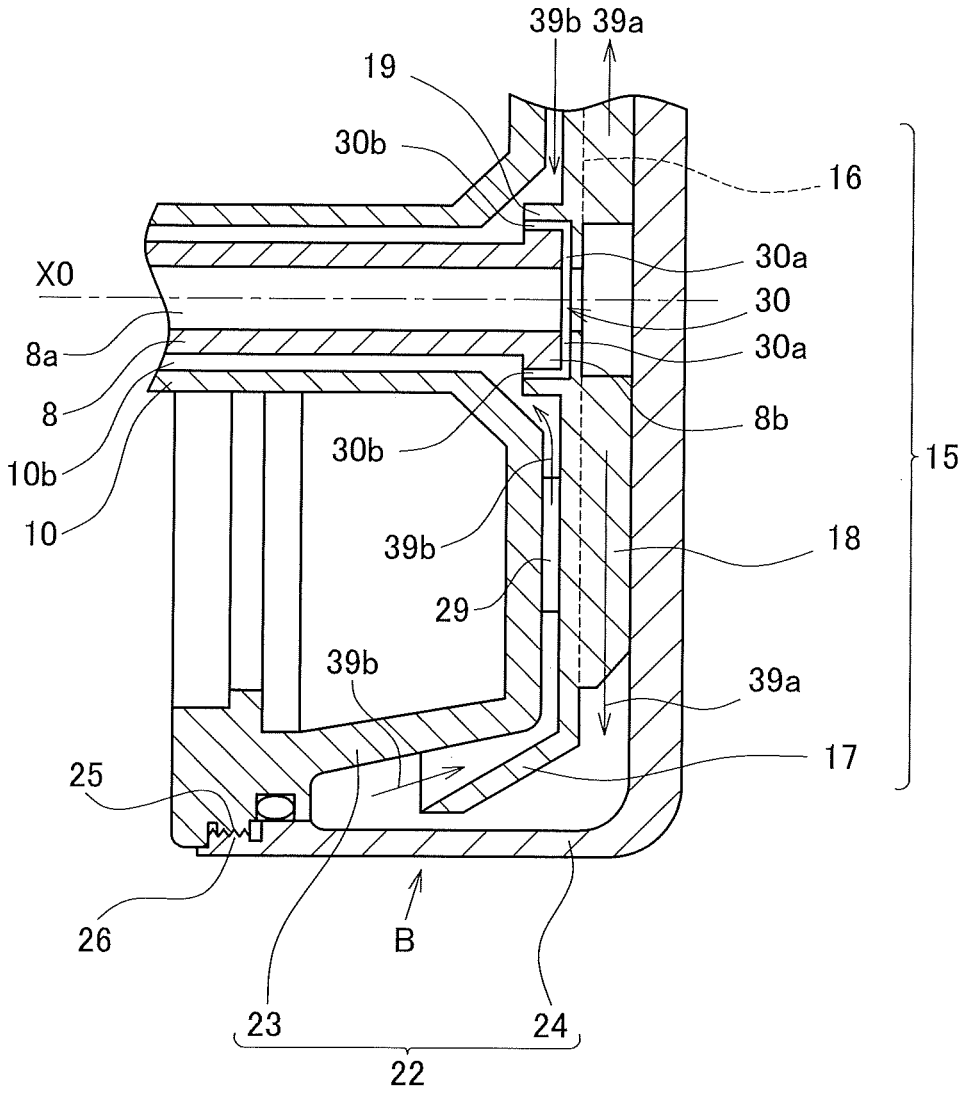
FIG. 5 is an enlarged view of the portion indicated by reference symbol A in FIG. 2.

FIG. 5 is an enlarged view of the lower half portion of a target 22 labeled as portion A in FIG. 2. The distal end part of the inner tube 8 on the right side thereof in FIG. 5 is formed as a disk-shaped expanded part 8*b* expanded in the radial direction (i.e., the direction at a right angle to the center axis X0). The inner tube 8 and the separator 15 are connected in a state in which the expanded part 8*b* is in the recess 19 on the back surface of the separator 15.

A target 22 is provided at the distal end of the outer tube 10 on the right side thereof in FIG. 2. The target 22 has a target bottom part 23 and a target body 24. End parts of the target bottom part 23 and the target body 24 on the left side in FIG. 2 are both open ends, end parts thereof on the right side in FIG. 2 are closed end parts, and side surface parts between the end parts on the left side and the end parts on the right side are cylindrical in shape. Thus, the target 22 is formed in a cup-shape. The target bottom part 23 is formed integrally with the outer tube 10.

An electron gun 21 is provided facing one location on a circumferential surface of the target body 24. The electron gun 21 has a filament 27. In FIG. 1, a tube voltage V (e.g., minus 60 kV) is applied between the filament 27 and the target 22 by a high-voltage source 20. A tube current I flows in the filament 27 to which the tube voltage V is applied. The filament 27 heats up at this time and generates thermoelectrons e. The thermoelectrons e impinge on the surface of the target 22, and X-rays R are generated from the region impinged upon by the thermoelectrons e. The region impinged upon by the thermoelectrons e, i.e., the region from which X-rays are generated, is an X-ray focus. The X-ray focus has a length×width size of 40 μm×400 μm, for example. Here, the length direction is the direction at a right angle to the paper surface in FIG. 2, and the width direction is the direction parallel to the paper surface in FIG. 2. A focus of this size has a small area, and is therefore referred to as a micro-focus. X-rays generated from this X-ray focus are referred to as micro-focused X-rays.

In FIG. 5, a male thread 25 is formed on an outer circumferential surface of the open end of the target bottom part 23. A female thread 26 is formed in an inner circumferential surface of the open end of the target body 24. The male thread 25 and the female thread 26 are fitted together, whereby the target bottom part 23 and the target body 24 are integrally assembled and the target 22 is formed. An outflow-side spacer 29 is formed on the surface of a closed end part of the target bottom part 23. The outflow-side spacer 29 is formed as a slender projection, the same as the fins 18 functioning as inflow-side spacers illustrated in FIGS. 3 and 4. A plurality of outflow-side spacers 29 are also provided. The plurality of outflow-side spacers 29 are also preferably disposed symmetrically about the center axis X0 in the same manner as the fins 18.

The target bottom part 23 is screwed into the target body 24 at the threads 25, 26, and the outflow-side spacer 29 of the target bottom part 23 thereby presses the fins (i.e., the inflow-side spacers) 18 of the separator 15 against the back surface of the closed end part of the target body 24. In this state, a cup-shaped gap 30 is formed between the expanded part 8*b* of the distal end of the inner tube 8 and a wall of the recess 19 in the back surface of the separator 15, as illustrated in FIG. 5. The reference symbol 30*a* indicates an upstream side of the gap 30, and the reference symbol 30*b* indicates a downstream side of the gap 30. The fins 18 of the separator 15 are pressed against the target body 24, and therefore, when the target 22 rotates about the center axis X0, the separator 15 also rotates together with the target 22. The gap 30 is formed between the expanded part 8*b* of the distal end of the inner tube 8 and the wall of the recess 19 of the separator 15, and the separator 15 can therefore rotate with respect to the fixed inner tube 8.

In FIG. 2, a direct motor 31 as a target driving device is provided on the periphery of the outer tube 10 inside the casing 5. The direct motor 31 has a rotor 32 provided on an outer circumferential surface of the outer tube 10, and a stator 33 provided on an inner circumferential surface of the casing 5. When electric power is conducted to the stator 33, a rotating magnetic field is generated, and because of the rotating magnetic field, the rotor 32 rotates about the center axis X0. As a result, the inner tube 8 rotates about the center axis X0.

A magnetic fluid seal device 36 is provided to the distal end part on the right side of the casing 5. The magnetic fluid seal device 36 is a well-known shaft sealing device. The magnetic fluid seal device 36 causes a magnetic fluid to be adsorbed by magnetic force on the outer circumferential surface of the outer tube 10, and thereby forms a magnetic fluid film on the outer circumferential surface of the outer tube 10. By the action of this magnetic fluid film, a pressure difference is maintained between atmospheric pressure on the outside of the vacuum container 2 and a vacuum inside the vacuum container 2 in a state in which the outer tube 10 is being rotated. A mechanical seal 37 is provided between a left end part of the outer tube 10 and a left end part of the casing 5. The mechanical seal 37 prevents leakage of cooling water as the coolant.

Figure 6:
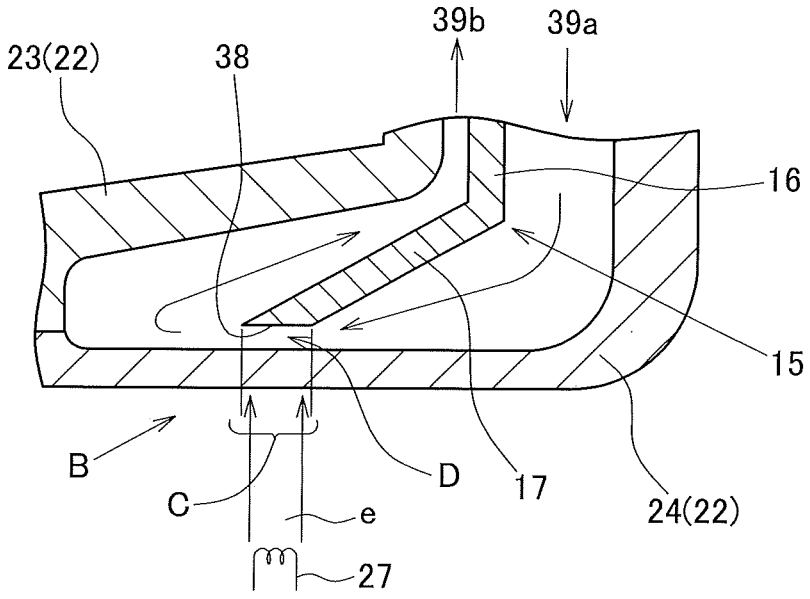
FIG. 6 is an enlarged sectional view of the X-ray generating portion of the target in FIG. 2.

In FIG. 2, the region on the surface of the target 22 where the X-ray focus is formed by the electron gun 21 is heated to a high temperature. This region must be cooled in order to generate X-rays continuously. This region will be referred to below as a cooling region B. The cooling region B is an annular region on the circumferential surface of the target body 24. In FIG. 6, an approach surface 38 formed at the distal end of the inclined part 17 of the separator 15 is disposed so as to correspond to the cooling region B. The region of the target body 24 that faces the approach surface 38 is a to-be-cooled surface C. The space in between the approach surface 38 and the to-be-cooled surface C is an approach passage D. The X-ray focus, which is the region of the target body 24 upon which electrons e emitted from the filament 27 impinge, is preferably included by the to-be-cooled surface C.

The space that is a portion interposed between the target body 24 and the separator 15 and that leads to the approach passage D is a coolant inflow path 39*a*. The coolant inflow path 39*a* is connected to the coolant inflow path 8*a* of the inner tube 8 in FIG. 2. In FIG. 6, the space that is interposed between the target bottom part 23 and the separator 15 and that leads out from the approach passage D is a coolant outflow path 39*b*. The coolant outflow path 39*b* is connected to the coolant outflow path 10*b*, which is the space between the outer tube 10 and the inner tube 8 in FIG. 2.

The operation of the X-ray generator 1 will next be described. In FIG. 1, the vacuum suction device 4 operates, and the inside of the vacuum container 2 is set to a vacuum state. The high-voltage source 20 operates, electrons are released from the filament 27, and X-rays R are emitted from the target 22. The target 22 is driven by the direct motor 31, and rotates about the center axis X0. The X-ray generator 13 operates, and water as the coolant is supplied to the X-ray generator 1 via the coolant supply tube 42 and the inlet fitting 9.

The supplied water flows in the following order in FIG. 2, i.e., in order of the coolant inflow path 8*a* of the inner tube 8, the coolant inflow path 39*a* in the target 22, the approach passage D (see FIG. 6) in the cooling region B, the coolant outflow path 39*b* (see FIG. 6) in the target 22, and the coolant outflow path 10*b* of the outer tube 10. The water is then recovered through the outlet fitting 12 and the coolant recovery tube 43 (see FIG. 1). When the coolant water flows through the approach passage D of FIG. 6 and the vicinity thereof, the to-be-cooled surface C including the X-ray focus of the target body 24 is cooled.

Figure 7:
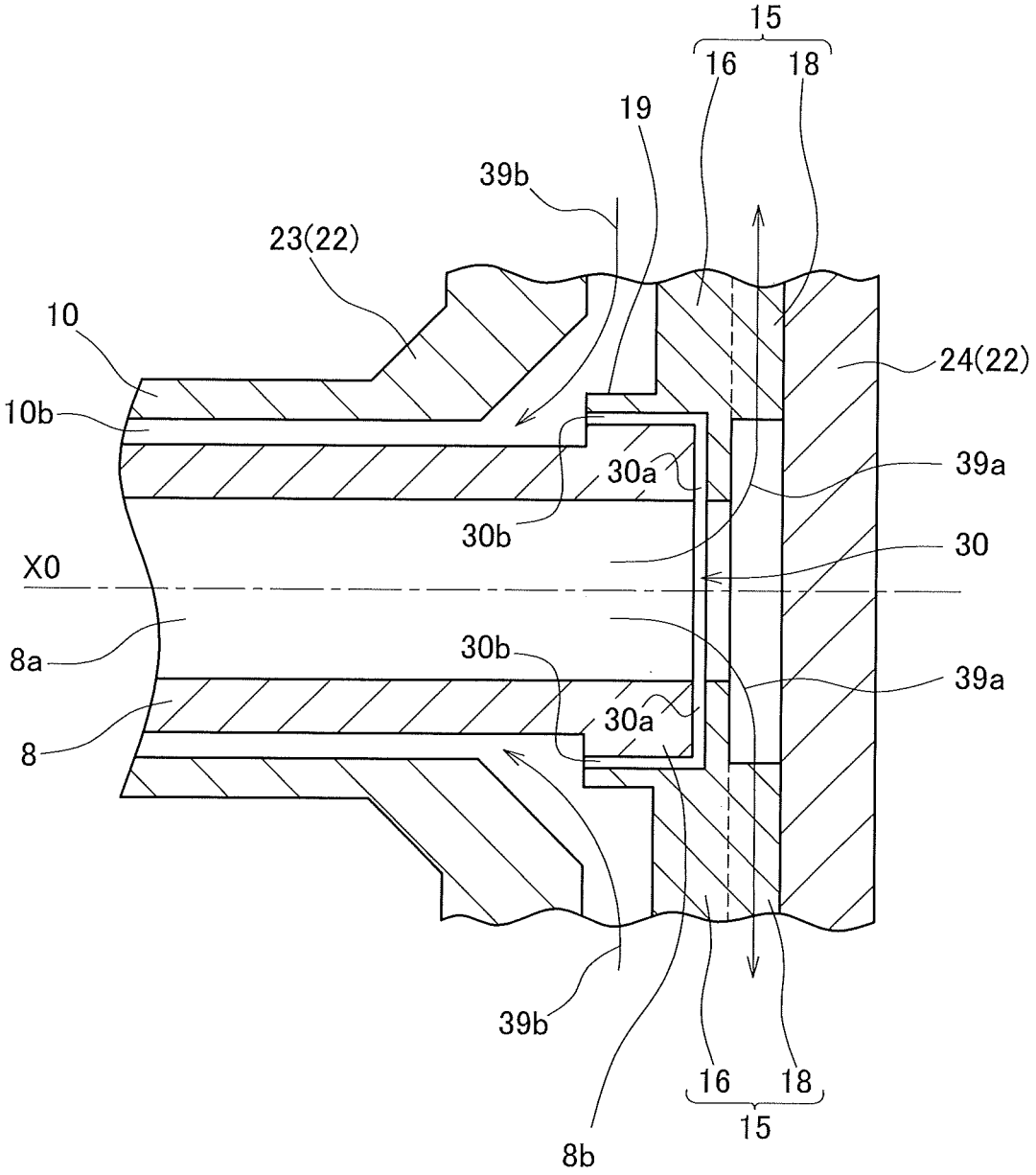
FIG. 7 is an enlarged sectional view of the main part of FIG. 5.

In the present embodiment, the fins 18 for functioning as spacers in the separator 15 are pressed against the inner surface of the target body 24, as illustrated in FIG. 7. Furthermore, the gap 30 is provided between the expanded part 8*b* of the distal end of the inner tube 8 and the wall of the recess 19 of the separator 15. Through these features, the inner tube 8 is fixed and does not move, but the separator 15 rotates together with the target 22 about the center axis X0.

The target 22 and the separator 15 thus rotate together in the same direction in the present embodiment, and there is therefore no difference in speed of the water between the inner surface of the target 22 and the outer surface of the separator 15 in the cooling region B in FIG. 2. The direct motor 31 for rotating the target 22 can therefore have a small torque. There is also no intense stirring of the water between the inner surface of the target 22 and the outer surface of the separator 15, and there is therefore little vibration of the X-ray generator 1.

Second Embodiment of the X-Ray Generator

Figure 8:
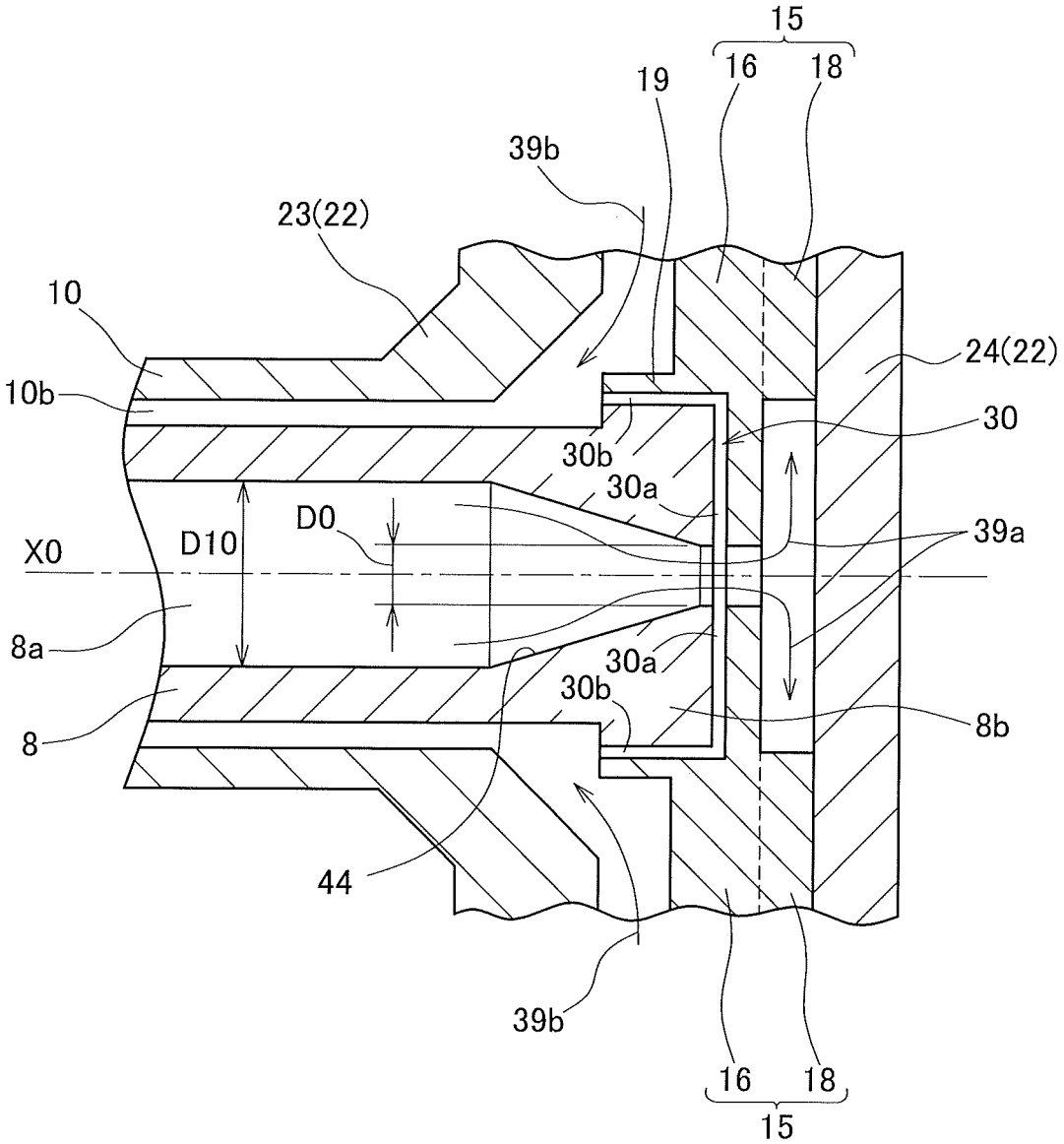
FIG. 8 is a sectional view illustrating the cross-sectional structure of a main part of another embodiment of the X-ray generator according to the present invention.

FIG. 8 illustrates the cross-sectional structure of a main part of another embodiment of the X-ray generator according to the present invention. In FIG. 8, a modification is added to the structure of the first embodiment illustrated in FIG. 7. Aspects of the structure of the present embodiment other than the structure illustrated in FIG. 8 are the same as in the first embodiment.

In the present embodiment, formation of the gap 30 between the expanded part 8*b* of the distal end of the inner tube 8 and the wall of the recess 19 of the separator 15 is the same as in the previously described embodiment illustrated in FIG. 7. It was described in the previous embodiment that cooling water as the coolant is supplied to the cooling region B in FIG. 2, and the to-be-cooled surface C including the X-ray focus in FIG. 6 is cooled. It was also described that a gap 30 is provided between the expanded part 8*b* of the distal end of the inner tube 8 and the wall of the recess 19 of the separator 15 in FIG. 7, and the inner tube 8 is thereby supported so as not to move, and the separator 15 is also rotated about the center axis X0.

However, in the embodiment illustrated in FIG. 7, a portion of the water flowing through the vicinity of an inlet of the gap 30 flows into the upstream side 30*a* of the gap 30 due to a pressure difference between the upstream side 30*a* and the downstream side 30*b* of the gap 30, the amount of water flowing toward the cooling region B in FIG. 2 is reduced, and there is considered to be a risk of decreased cooling efficiency in the cooling region B. In the present embodiment illustrated in FIG. 8, however, a tapered tube 44 as a coolant flow velocity accelerating device is formed in the distal end part of the inner tube 8. The cross-sectional diameter of the tapered tube 44 gradually decreases progressively in the flow direction (left-to-right direction of FIG. 8) of the cooling water. The cross-section of the tapered tube 44 is smallest where the tapered tube 44 opens to the gap 30.

As a result of providing the tapered tube 44, the flow velocity near the opening of the gap 30 on the coolant inflow path 8*a* side thereof becomes greater than the flow velocity of the cooling water flowing through an upstream region of the coolant inflow path 8*a*. As a result of the decreased flow rate of the cooling water near the opening of the gap 30, the pressure (static pressure) on the upstream side of the gap 30 is decreased relative to a case in which the tapered tube 44 is not provided (the state of FIG. 7), due to Bernoulli's principle. The pressure on the upstream side 30*a* of the gap 30 is thus reduced in the present embodiment, and can be made substantially the same as on the downstream side 30*b* of the gap 30 facing a return path for the cooling water that has passed through the cooling region B. The amount of water that flows into the gap 30 during operation of the X-ray generator can therefore be reduced, and an amount of water commensurate with the reduction can be sent into the cooling region B of FIG. 2. As a result, in the cooling region B, the to-be-cooled surface C of the target 22 in FIG. 6 can be efficiently cooled.

Third Embodiment of the X-Ray Generator

Figure 9:
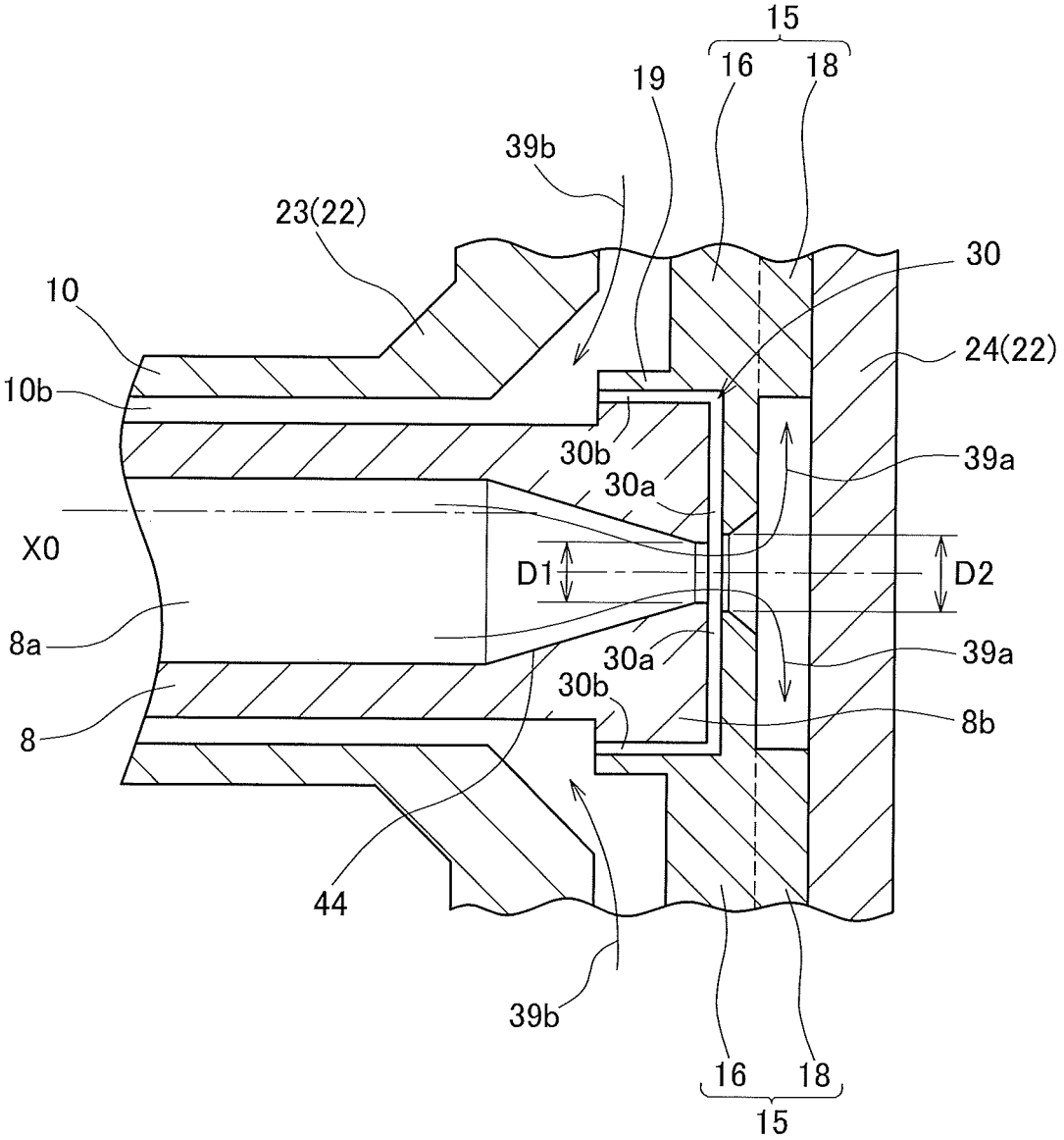
FIG. 9 is a sectional view illustrating the cross-sectional structure of a main part of yet another embodiment of the X-ray generator according to the present invention.

FIG. 9 illustrates the cross-sectional structure of a main part of yet another embodiment of the X-ray generator according to the present invention. In FIG. 9, a modification is added to the structure of the second embodiment illustrated in FIG. 8. Aspects of the structure of the present embodiment other than the structure illustrated in FIG. 9 are the same as in the first embodiment.

In FIG. 9, the diameter of a first opening as an end opening on a small-area side of the tapered tube 44 is designated as D1, and the diameter of a second opening as an opening for receiving the cooling water exiting the opening of the tapered tube 44 is designated as D2. The expression $$T=Q2/Q1$$

is the cooling water shortcut rate, where Q1 is the total amount of cooling water flowing through the inner tube 8, and Q2 is the amount of cooling water flowing into the gap 30. In the present embodiment, the condition $$1.2D1 \leq D2 \leq 1.27D1$$

is set, and the shortcut rate T is kept to a small value by this condition.

Other Embodiments

Preferred embodiments of the present invention are described above, but the present invention is not limited to these embodiments and various modifications may be made thereto within the scope of the invention as recited in the claims.

For example, in the embodiment illustrated in FIG. 7 in which the tapered tube is not used, the flow direction of the cooling water may be reversed. In other words, the inlet fitting 9 and the outlet fitting 12 in FIG. 2 may be reversed.

Example 1

Figure 10:
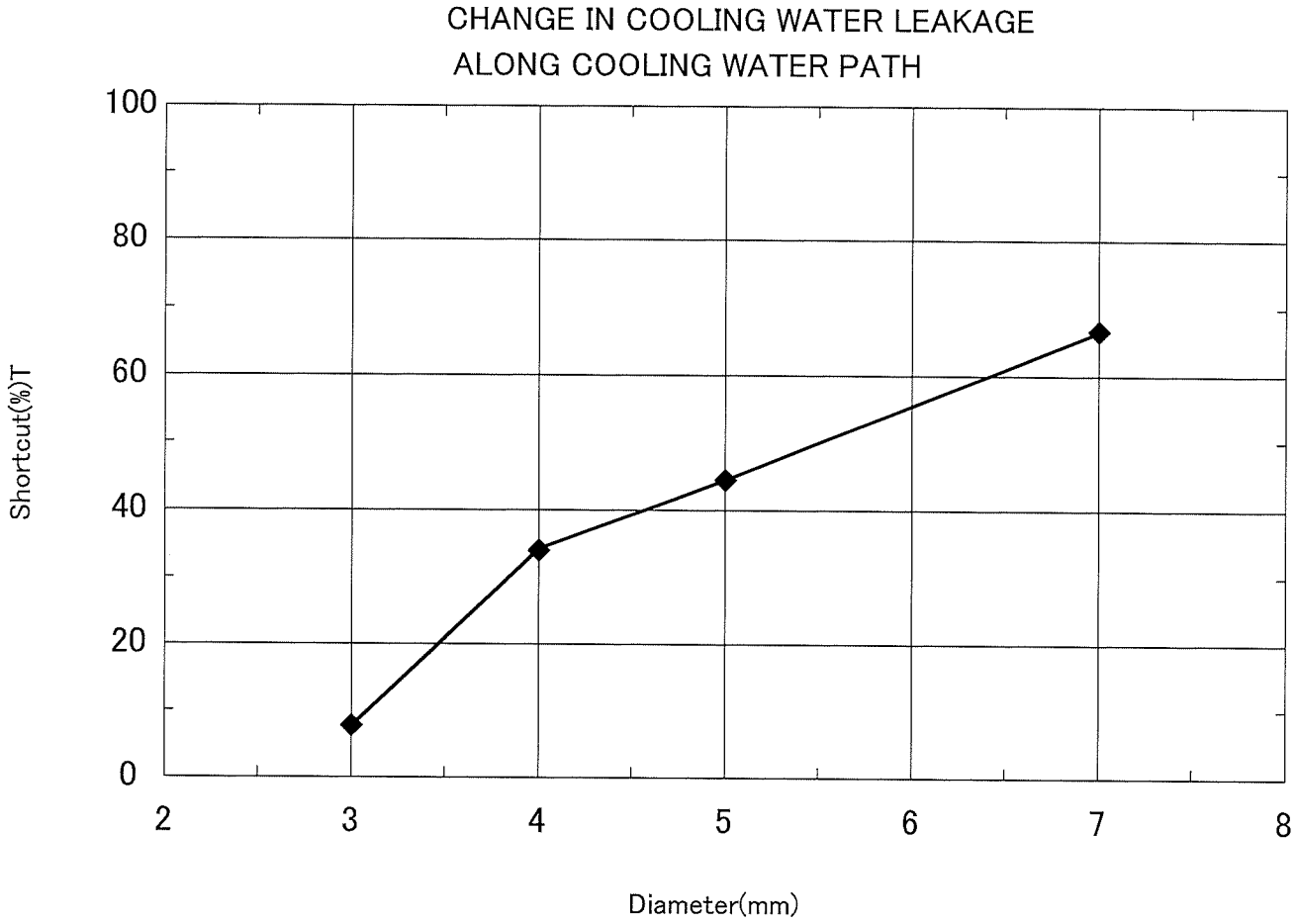
FIG. 10 is a graph illustrating a relationship between the cross-sectional diameter of a coolant inflow path and a shortcut rate.

The inside diameter D10 of the inner tube 8 in FIG. 8 was set to 7 mm, and the shortcut rate T when the diameter D0 of the opening of the tapered tube 44 at the gap 30 was changed to 3 mm, 4 mm, 5 mm, and 7 mm was calculated by simulation software. The results illustrated in FIG. 10 were thereby obtained. According to the graph of FIG. 10, by decreasing the opening diameter D0 of the tapered tube 44, the shortcut rate T can be reduced and cooling efficiency in the cooling region B in FIG. 2 can be increased. However, it is not practical to decrease the opening diameter D0 too much, as this leads to a large pressure loss in the cooling water flow path. According to the simulation experiment, an opening diameter D0 of 3 mm for the tapered tube 44 is satisfactory.

Example 2

Figure 11:
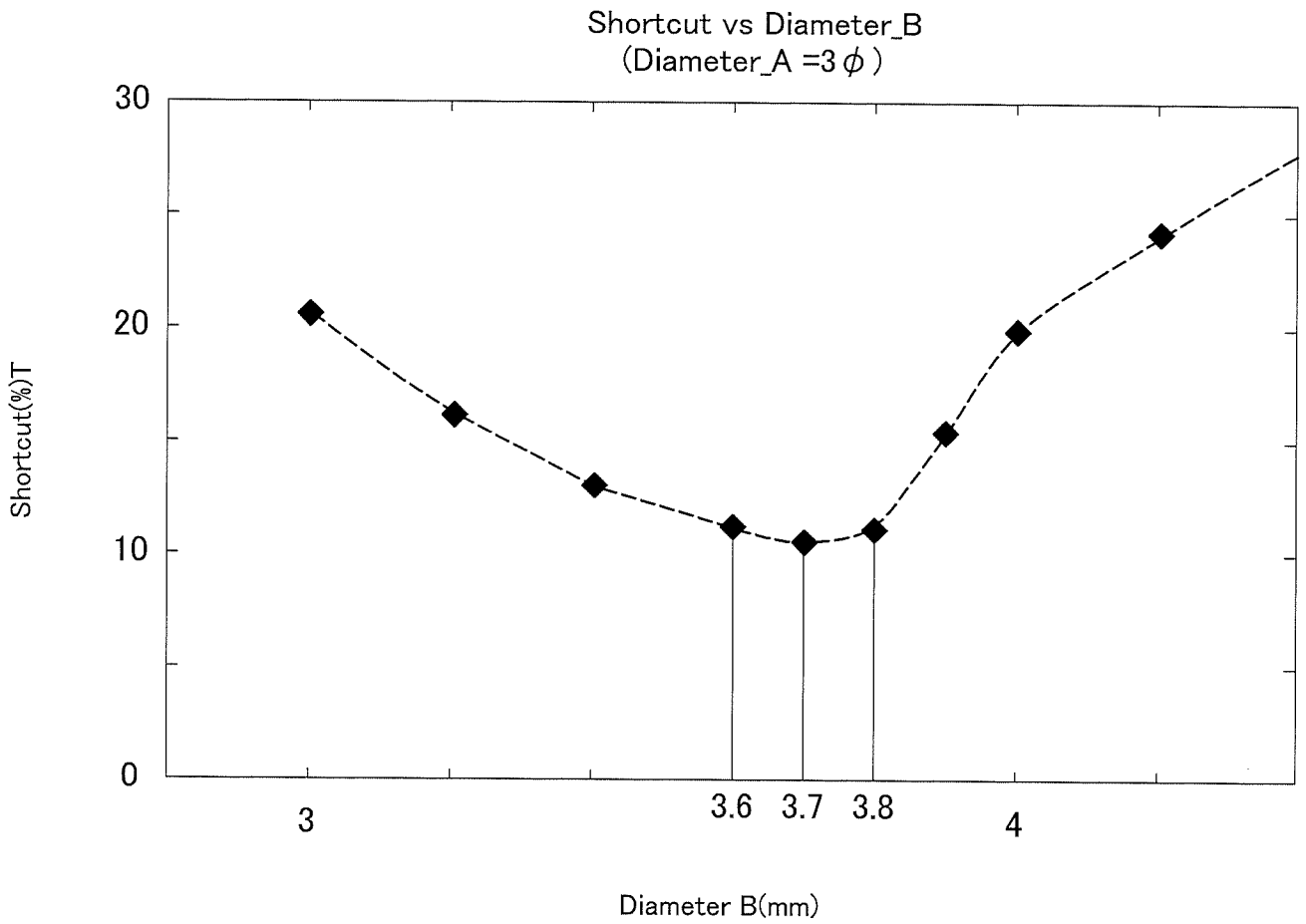
FIG. 11 is a graph illustrating another relationship between the cross-sectional diameter of the coolant inflow path and the shortcut rate.

The diameter D1 of the first opening in FIG. 9 was fixed at 3 mm and the diameter D2 of the second opening was changed from 3.0 mm to 4.2 mm, and the shortcut rate T was calculated by simulation software. The results illustrated in FIG. 11 were thereby obtained. According to the graph of FIG. 11, the shortcut rate T was lowest when the diameter D2 of the second opening was 3.7 mm. Judging from the graph, a satisfactory shortcut rate T was obtained when the diameter D2 of the second opening was in the range of 3.6 mm to 3.8 mm. Considering that the diameter D1 of the first opening is 3 mm, 3.6 mm is 1.2 times the diameter D1, and 3.8 mm is 1.27 times the diameter D1. Consequently, the relationship below is considered to be preferred for the diameter D1 of the first opening and the diameter D2 of the second opening.

$$1.2D1 \leq D2 \leq 1.27D1$$

Example 3

Figure 12:
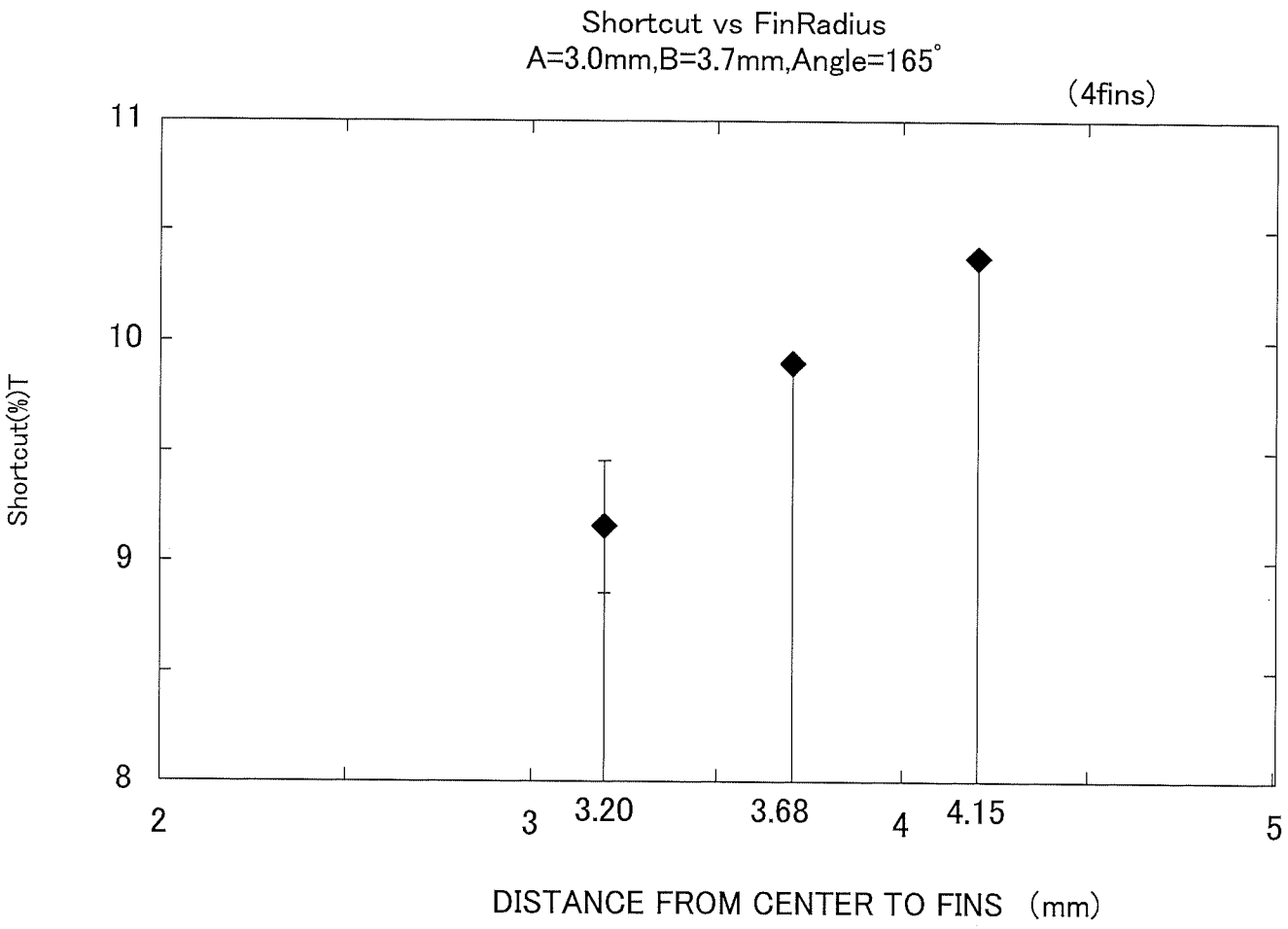
FIG. 12 is a graph illustrating a relationship between the arrangement position of fins provided to the coolant inflow path and the shortcut rate.

In FIG. 9, D1 was set to 3.0 mm and D2 was set to 3.7 mm, and the respective shortcut rate T when the distance L from the center X0 of the separator 15 to the four fins 18 in FIG. 3 was changed to 3.20 mm, 3.68 mm, and 4.15 mm was calculated by simulation software. The results illustrated in FIG. 12 were thereby obtained. Judging from the graph, the shortcut rate T decreases when the distance from the center X0 to the fins 18 is reduced, and it was apparent that the target cooling effect can thereby be increased. However, it is necessary for the diameter D2 of the second opening in FIG. 9 to have a certain size, and for this reason, the fins 18 must be at least a certain distance from the center X0.

DESCRIPTION OF SYMBOLS

1: X-ray generator, 2: vacuum container, 3: anode assembly, 4: vacuum suction device, 5: casing, 6: flange, 8: inner tube, 8*a*: coolant inflow path (cooling system), 8*b*: expanded part, 9: inlet fitting, 10: outer tube, 10*b*: coolant outflow path (cooling system), 11*a*, 11*b*: bearings, 12: outlet fitting, 13: coolant supply device (cooling system), 15: separator, 16: circular plate part, 17: inclined part, 18: fins (inflow-side spacers), 19: recess, 20: high-voltage source, 21: electron gun, 22: target, 23: target bottom part, 24: target body, 25: male thread, 26: female thread, 27: filament, 29: outflow-side spacer, 30: gap, 30*a*: upstream side of gap, 30*b*: upstream side of the gap, 31: direct motor (target driving device), 32: rotor, 33: stator, 36: magnetic fluid seal device, 37: mechanical seal, 38: approach surface, 39*a*: coolant inflow path, 39*b*: coolant outflow path, 42: coolant supply tube, 43: coolant recovery tube, 44: tapered tube, B: cooling region, C: to-be-cooled surface, D: approach passage: e: thermoelectrons, I: tube current, L: distance, R: X-rays, V: tube voltage, X0: center axis

The invention claimed is:

1. An X-ray generator comprising:

a target for receiving electrons and generating X-rays;

a separator for dividing an internal space of the target into a coolant inflow path and a coolant outflow path;

a target driving device for rotating said target;

a cooling system for supplying a coolant to said coolant inflow path and recovering the coolant through said coolant outflow path;

a hollow inner tube for supporting said separator so that the separator can rotate about a center of the separator; and a gap for allowing said separator to rotate independently of the inner tube, the gap being provided to a portion of said inner tube that supports said separator;

wherein said separator rotates in the same rotation direction as said target when the target rotates.

2. The X-ray generator according to claim 1, wherein said separator rotates at the same rotation speed as said target.

3. The X-ray generator according to claim 1, wherein said separator comprises a protruding spacer; and the spacer is pressed on an inner surface of said target, whereby said separator rotates when said target rotates.

4. The X-ray generator according to claim 3, wherein said spacer is a fin for guiding a flow of said coolant.

5. The X-ray generator according to claim 1, comprising:

a hollow outer tube provided coaxially with the inner tube; wherein said target is supported by said outer tube;

a hollow part of said inner tube is communicated with said coolant inflow path; and a hollow part between an inner surface of said outer tube and an outer surface of said inner tube is communicated with said coolant outflow path.

6. The X-ray generator according to claim 1, comprising a coolant flow velocity accelerating device for increasing the velocity of the coolant in said inner tube at the location thereof where said gap is provided.

7. The X-ray generator according to claim 6, wherein said coolant flow velocity accelerating device is a tapered tube in which the diameter of said inner tube gradually decreases.

8. The X-ray generator according to claim 7, wherein a first opening as an end opening on a small-area side of said tapered tube is open in one wall surface of said gap;

a second opening as an opening for receiving the coolant exiting the opening of said tapered tube is open in another wall surface of said gap; and $1.2D1 \leq D2 \leq 1.27D1$, where D2 is the diameter of said second opening and D1 is the diameter of said first opening.

9. The X-ray generator according to claim 1, wherein the inner tube is fixed and does not move, the separator rotates together with the target about the center axis.

* * * * *